US008215227B2

(12) United States Patent
Siivonen et al.

(10) Patent No.: US 8,215,227 B2
(45) Date of Patent: Jul. 10, 2012

(54) DETECTING OF FAULTS IN A VALVE SYSTEM AND A FAULT TOLERANT CONTROL

(75) Inventors: Lauri Siivonen, Tampere (FI); Matti Linjama, Valkkinen (FI)

(73) Assignee: Robert Bosch GmbH, Stuttgart (DE)

( * ) Notice: Subject to any disclaimer, the term of this patent is extended or adjusted under 35 U.S.C. 154(b) by 841 days.

(21) Appl. No.: 11/991,559

(22) PCT Filed: Sep. 6, 2006

(86) PCT No.: PCT/FI2006/050381

§ 371 (c)(1), (2), (4) Date: Jan. 22, 2009

(87) PCT Pub. No.: WO2007/028863

PCT Pub. Date: Mar. 15, 2007

(65) Prior Publication Data

US 2009/0114284 A1 May 7, 2009

(30) Foreign Application Priority Data

Sep. 6, 2005 (FI) ..... 20055479

(51) Int. Cl.
*F15B 19/00* (2006.01)
*F15B 11/04* (2006.01)

(52) U.S. Cl. ..... 91/444; 60/368

(58) Field of Classification Search ..... 60/368, 60/433; 91/444, 454

See application file for complete search history.

(56) References Cited

U.S. PATENT DOCUMENTS 2,999,482 A 9/1961 Bower (Continued)

FOREIGN PATENT DOCUMENTS

DE 102004006683 A1 9/2005

(Continued)

OTHER PUBLICATIONS

Matti Linjama et al; Improved Digital Hydraulic Tracking Control of Water Hydraulic Cylinder Drive; International Journal of Fluid Power; vol. 6, No. 1, Mar. 2005; 16 pages.

(Continued)

*Primary Examiner* — Thomas E Lazo

(74) *Attorney, Agent, or Firm* — Venable LLP; Eric J. Franklin

(57) ABSTRACT

In a method for controlling a valve system controlling an actuator, the first direction of motion of the actuator is controlled solely by the first and the second valve series; or, its second direction of motion is controlled solely by the third and the fourth valve series; and an error caused by a fault situation in the control of the actuator is compensated for by using, for the control of the first direction of motion, also the third valve series, the fourth valve series, or both of them; or, an error in the control of the actuator caused by a fault situation is compensated for by using, for the control of the second direction of motion, also the first valve series, the second valve series, or both of them. In the method, for searching for faults in the valve system controlling the actuator, the pressure of the inlet port of the valve system, the pressure of the first working port, and the pressure of the outlet port are determined; one or more valves of the first valve series and one or more valves of the second valve series are opened; the measured pressure of the first working port is compared with a situation corresponding to a system operating correctly; and on the basis of the comparison it is concluded whether the single valve is faulty or not.

26 Claims, 7 Drawing Sheets

U.S. PATENT DOCUMENTS

| | | | |
|---|---|---|---|
| 6,467,264 | B1 | 10/2002 | Stephenson et al. |
| 2007/0119298 | A1 | 5/2007 | Steinborn et al. |

FOREIGN PATENT DOCUMENTS

| | | | | |
|---|---|---|---|---|
| DE | 102004006683 | A1 | * | 9/2005 |
| WO | WO-02/086327 | A1 | | 10/2002 |

OTHER PUBLICATIONS

Matti Linjama et al; Digital Hydraulic Tracking Control of Mobile Machine Joint Actuator Mockup; The Ninth Scandinavian International Conference on Fluid Power, SICFP, Jun. 1-3, 2005, 16 pages.
PCT/ISA/210—International Search Report—Dec. 29, 2006.

* cited by examiner

DETECTING OF FAULTS IN A VALVE SYSTEM AND A FAULT TOLERANT CONTROL

FIELD OF THE INVENTION

The invention relates to a method for controlling a valve system controlling an actuator. The invention relates to a method for testing faults in a valve system controlling an actuator. The invention also relates to a valve system for the control of an actuator.

BACKGROUND OF THE INVENTION

In hydraulics, power is transmitted by means of pressure and volume flow. Normally, the volume flow is generated by a pump, and the resistance caused by the system increases the pressure. Normally, the aim is to move actuators, such as cylinders and motors, by means of the volume flow and the pressure. Because the actuators must normally be moved in both directions, either back and forth or changing the direction of circulation, and possibly even be stopped, valves are needed for controlling the volume flow. When the actuators are to be moved precisely, for example at a specific rate, accurate valves are needed to control the volume flow. Conventionally, such valves are so-called proportional valves. Proportional valves have been used already for decades, and there are several different valves functioning on the same basic principle. FIG. 1 shows a way of coupling a proportional valve to a hydraulic actuator, and FIG. 2 shows the characteristic curve of a conventional four-way proportional valve. In practice, a certain control signal u is used to achieve a position of the slide of the proportional valve to provide simultaneous openings of the proportional valve of given magnitude (i.e. simultaneous control of two control edges), for example from port P to port A and from port B to port T (FIG. 1).

Better controllability is achieved if more than one proportional valve is used for controlling the actuator, because all the control edges can be controlled independently, irrespective of the each other. In FIG. 3, such a control with four control edges is implemented by 2/2 proportional valves. By means of the system, better efficiency and controllability are achieved, but on the other hand, the implementation is expensive due to the high prices of the single valves.

A digital hydraulic valve system is a kind of a proportionally functioning directional valve. The valve system consists of simple and robust on/off valves coupled in parallel. The valves are arranged in such a way that by their different opening combinations it is possible to achieve a gradual control response at each control edge. This technique is also known as Pulse Code Modulation, or PCM. Document U.S. Pat. No. 2,999,482 is mentioned as an example. FIG. 4 shows one control edge of a digital hydraulic valve system, or Digital Flow Control Unit (DFCU), and its control response, when the volume flow rates of the valves are selected so that the following valve is always twice as large as the preceding one. In the control response, the flow rate Q is shown as a function of the control input.

The digital hydraulic valve system normally consists of either two or four separate DFCU's. A single DFCU can be made in several ways, of which the binary, Fibonacci and Pulse Number Modulation (PNM) based solutions are the most examined ones. The basic principle of the control of the digital hydraulic valve system is discussed in WO 02/086327 A1, which corresponds to patent application FI 20010827 A.

Table A shows, in a general case, the ratio between the opening combinations and the total opening of a valve series in one DFCU ($Q_j$: the flow rate through a valve j). It can be seen in the table that 16 different flow rate values can be obtained with four valves. In a corresponding manner, 32 and 64 flow rate values would be obtained with five and six valves, respectively.

FIG. 5 shows a digital hydraulic valve system implemented with four separately adjustable control edges. Each valve series typically comprises 4 to 6 valves coupled in parallel, wherein the whole valve system comprises 16 to 24 valves.

TABLE A

| DFCU state | Valve 1 | Valve 2 | Valve 3 | Valve 4 | Flow rate |
|---|---|---|---|---|---|
| 0 | 0 | 0 | 0 | 0 | 0 |
| 1 | 1 | 0 | 0 | 0 | $Q_1$ |
| 2 | 0 | 1 | 0 | 0 | $Q_2$ |
| 3 | 1 | 1 | 0 | 0 | $Q_1 + Q_2$ |
| 4 | 0 | 0 | 1 | 0 | $Q_3$ |
| 5 | 1 | 0 | 1 | 0 | $Q_1 + Q_3$ |
| 6 | 0 | 1 | 1 | 0 | $Q_2 + Q_3$ |
| 7 | 1 | 1 | 1 | 0 | $Q_1 + Q_2 + Q_3$ |
| 8 | 0 | 0 | 0 | 1 | $Q_4$ |
| 9 | 1 | 0 | 0 | 1 | $Q_1 + Q_4$ |
| 10 | 0 | 1 | 0 | 1 | $Q_2 + Q_4$ |
| 11 | 1 | 1 | 0 | 1 | $Q_1 + Q_2 + Q_4$ |
| 12 | 0 | 0 | 1 | 1 | $Q_3 + Q_4$ |
| 13 | 1 | 0 | 1 | 1 | $Q_1 + Q_3 + Q_4$ |
| 14 | 0 | 1 | 1 | 1 | $Q_2 + Q_3 + Q_4$ |
| 15 | 1 | 1 | 1 | 1 | $Q_1 + Q_2 + Q_3 + Q_4$ |

In proportional valves of prior art, fault tolerance is primarily limited to the robust structure and fail-safe properties of the valve. In practice, if there is a fault in the valve, the input current to the valve is switched off and so-called centering springs drive the slide either to the central position or to another "safe" position. In some feedback systems, in case of a fault it is possible to try to increase for example the input current to achieve a desired position of the stem. In some valves, a fault condition is indicated to the operator either by means of light signals (e.g. LED) or, for example, a CAN message (Controller Area Network). Even in these cases it is still not possible to speak about actual fault tolerance. In some critical uses, such as ships and aircrafts, tandem systems may be used, with a duplicate component for each component. These duplicate components can be used in case of a fault, and the faulty part is disconnected from the system. In some cases, only those parts which are susceptible to failure are duplicated.

In the system of four proportional valves shown in FIG. 3, some kinds of operations can be performed even under a failure. With the system, it is possible, for example, to move an actuator in only one direction or, in some cases, to stop an actuator moved by a valve that has been jammed open. However, in practice, the system is unserviceable in the case of one faulty valve.

The valve system of FIG. 5, comprising four separate valve series, has been discussed in the conference publication '*Digital hydraulic tracking control of mobile machine joint actuator mockup*'; Linjama M., Vilenius M., The Ninth International Conference on Fluid Power, SICFP'05, Jun. 1-3, 2005 Linköping, Sweden. The system of FIG. 5 has also been introduced in the article '*Improved digital hydraulic tracking control of water hydraulic motor drive*'; Linjama M., Vilenius M., International Journal of Fluid Power, Volume 6, Number 1, March 2005.

In the system according to the article, the control and, for example, solely the extend stroke of the actuator is implemented by using even three or all the four valve series, whose all opening combinations are worked out, and the suitable one is selected by optimation. However, the article does not point out a fault situation, its detection, nor a measure to compensate for a failure of the valves and the effect of the fault situation on the control.

SUMMARY OF THE INVENTION

It is an aim of the present invention to introduce a method for detecting faults in a digital hydraulic valve system. Furthermore, it is an aim of the invention to introduce a method for reacting to the detected faults in such a way that the operation of the actuator can be continued in the best case without a noticeable effect on the normal operation of the system. In conventional arrangements, this is not possible without duplicating the valve and isolating the faulty valve from the rest of the system.

In one embodiment of the invention, the valve system comprises four valve series (DFCU), but in a situation in which the valves operate normally, i.e. without faults, for example only two valve series (control edges DFCU P→A and DFCU B→T) are used for the extend stroke of the actuator, and the two other valve series (control edges DFCU P→B and DFCU A→T) are used for the retract stroke. In the case of a fault, which will be shown by table B below, one of the remaining valve series (DFCU P→B or DFCU A→T) is employed to compensate for the effect of the fault, for example by an extend stroke, depending on the valve series where the fault is (DFCU P→A or DFCU B→T).

In a fault situation, it is typical that a suitable opening is no longer found in a faulty valve. In the first example, the utilization of too large an opening may be intentional, because a part of the volume flow can be directed to a tank port if it is not possible to find a correct or suitable smaller opening. Also in the second example, the utilization of too large an opening is intentional, because it is not possible to find a correct or suitable smaller opening.

According to the first example, either an excessive volume flow is directed to the actuator (the opening of the DFCU P→A is too large because of the open valve), or according to the second example, an excessive volume flow is directed away from the actuator (the opening of the DFCU B→T is too large because of the open valve). In the first example, the principle of compensation is to direct the volume flow both to the actuator and to the outlet port T (via DFCU A→T), wherein the total volume flow entering the actuator is reduced accordingly. In the second example, the volume flow is directed to the actuator and also the working port B (via DFCU P→B), where also the volume flow exiting the actuator is summed up, and the summed volume flow is directed to the control edge (DFCU B→T). For the retract stroke, the same general principles are applied, but the functions of the valve series are interchanged.

Further, one embodiment of the invention is characterized in that after the fault has been detected, the control principle of the control system is corrected. Depending on the type of the fault, the matrix used in the mathematical computation, which assumes that the valves of all the valve series operate normally, is corrected to match to the condition of the faulty valve and the opening combinations available after the fault. One feature of the invention is the finding that the control method and control system presented in the above-mentioned article and conference publication operate again quite normally after said correcting measure, take the fault fully into account, and are capable of continuing the optimized control of the actuator. Consequently, as a result of the fault, the control is extended from the control of two valve series to the control of either three or four valve series.

The greatest advantage of the presented system is that a fault in a valve does not prevent the operation of the system. If a valve is jammed fully open or remains partly open (table B, cases II to V), the reprogramming of the controller for the part of a single valve series may no longer be a sufficient measure. It is an advantage of the invention that the fault can be compensated for by using "extra" valve series. The valve series needed for the compensation are ready in the system which comprises four control edges. Other advantages include, for example, the fact that the system can be tested also under a load, and the actuator does not necessarily move at all during the tests. The effect of the faulty valves on the operation of the system can also be determined without using expensive and space consuming flow rate sensors. Typically, the pressure sensors are provided ready in the system. The sensors are used, for example, to monitor the pressures $p_A$, $p_B$, $p_P$ and $p_T$, and they are also used for fault analysis.

BRIEF DESCRIPTION OF THE DRAWINGS

The invention will be described in more detail with reference to the appended drawings, in which.

MORE DETAILED DESCRIPTION OF THE INVENTION

Figure 1:
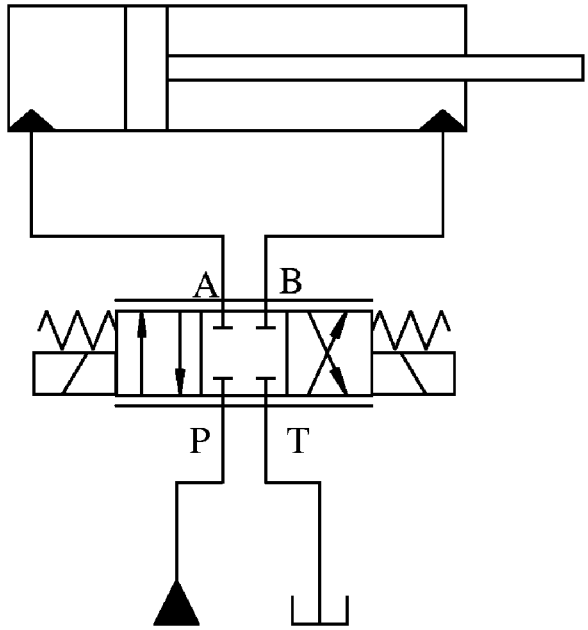
FIG. 1 shows a method of coupling a proportional valve.
Figure 2:
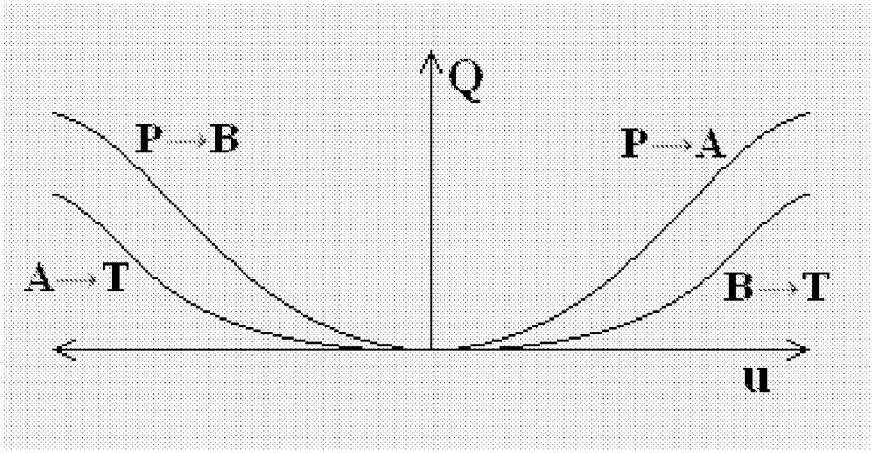
FIG. 2 shows the characteristic curve of a proportional valve.
Figure 3:
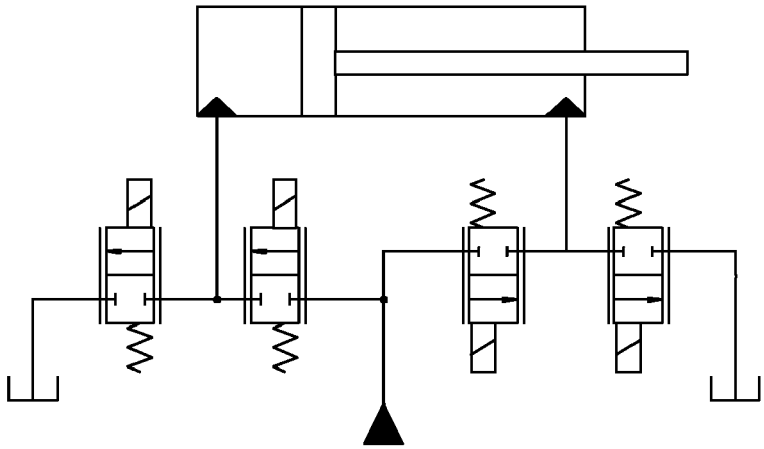
FIG. 3 shows the control of an actuator by means of four proportional valves.
Figure 4:
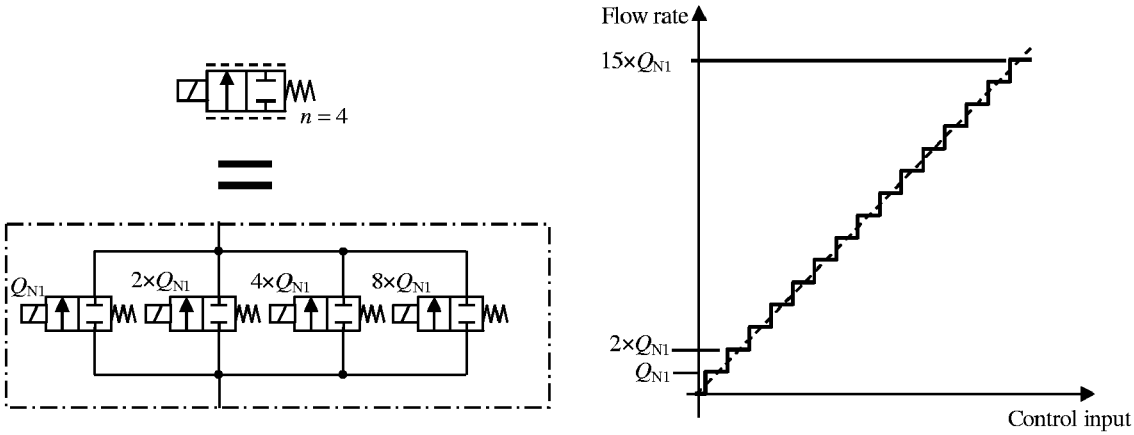
FIG. 4 shows a valve series in a digital hydraulic valve system, and its control response.
Figure 5:
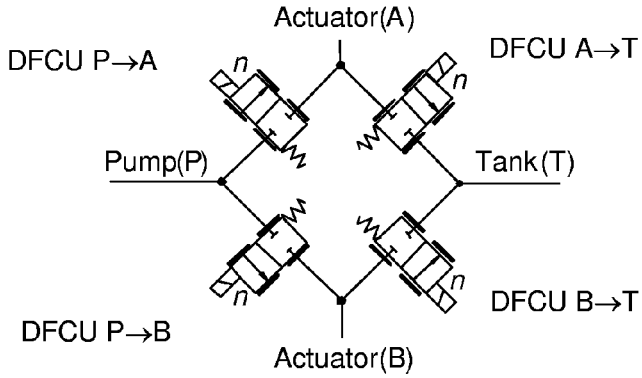
FIG. 5 shows a digital hydraulic valve system.

1. Fault Tolerant Control of a Valve System

The flow rate Q passed by a single valve can be calculated by the formula $$Q=\kappa av(u)\sqrt{\Delta p}$$

in which κ is the flow factor of the valve, av(u) is the opening of the valve as a function of the control u, and Δp is the pressure difference over the valve.

A variety of faults may occur in an on/off valve. In a normally operating valve, the valve is fully closed (opening=0) when the control is off (marked: control=0), and the valve is fully open (opening=1) when the control is on (marked: control=1). Consequently, the control and the opening correspond to each other after a coupling transient. If the opening of the valve does not match with the value of the control signal, there is a fault somewhere. Let us define a two-valued function av to reflect the opening of the valve as a function of the control. The markings av(0) and av(1) indicate the value of the opening when the control is off and on, respectively. Table B lists a variety of most typical fault types and describes their behaviour in fault situations. The opening of the valve is between 0 and 1. The figures x and y indicate an opening between the open and closed positions. There are also valves which are normally open, wherein their function is reverse.

TABLE B

| Fault | Opening of valve when control is off, av(0) | Opening of valve when control is on, av(1) | Case |
|---|---|---|---|
| Normal situation | 0 | 1 | — |
| Valve jammed closed | 0 | 0 | I |
| Valve jammed open | 1 | 1 | II |
| Valve jammed in an intermediate position | x | x | III |
| Valve does not open fully or valve throughput reduced for another reason | 0 | x | IV |
| Valve does not close fully | x | 1 | V |
| Valve does not close nor open fully | x | y | VI |

The fault situation I may be caused, for example, by a break of a cable or a connector; the fault situation II by a short circuit; and the fault situation III by a particle stuck between the closing means and the frame of the valve. The fault situation IV, in turn, may occur if the flow opening of the valve is partly blocked; the fault situation V if the sealing face of the valve is damaged; and the fault situation VI for example as a combination of the fault situations IV and V.

Table B shows 6 different fault situations. Let us look at a situation in which there are 3 valves in parallel and a fault occurs in the middle one. All the possible control combinations of the three valves can be illustrated by means of the following matrix B:

$$B = \begin{bmatrix} 0 & 1 & 0 & 1 & 0 & 1 & 0 & 1 \\ 0 & 0 & 1 & 1 & 0 & 0 & 1 & 1 \\ 0 & 0 & 0 & 0 & 1 & 1 & 1 & 1 \end{bmatrix}$$

$$\text{State}: 0 \quad 1 \quad 2 \quad 3 \quad 4 \quad 5 \quad 6 \quad 7$$

Each column in the matrix represents the controls of the valves at a given state value of the DFCU.

In a normal situation, the opening of the valve is the same as its control, wherein all three opening combinations of the three valves can be presented by the matrix B. In case I, the middle valve is jammed in the closed position. Thus, the openings of the DFCU with the values of the different states are:

$$AV = \begin{bmatrix} 0 & 1 & 0 & 1 & 0 & 1 & 0 & 1 \\ 0 & 0 & 0 & 0 & 0 & 0 & 0 & 0 \\ 0 & 0 & 0 & 0 & 1 & 1 & 1 & 1 \end{bmatrix}$$

In case II, the valve is jammed in the open position. The opening combinations are:

$$AV = \begin{bmatrix} 0 & 1 & 0 & 1 & 0 & 1 & 0 & 1 \\ 1 & 1 & 1 & 1 & 1 & 1 & 1 & 1 \\ 0 & 0 & 0 & 0 & 1 & 1 & 1 & 1 \end{bmatrix}$$

In the case III, the valve is jammed in a position x between the open and closed positions. The opening combinations are:

$$AV = \begin{bmatrix} 0 & 1 & 0 & 1 & 0 & 1 & 0 & 1 \\ x & x & x & x & x & x & x & x \\ 0 & 0 & 0 & 0 & 1 & 1 & 1 & 1 \end{bmatrix}$$

In case IV, the valve operates in such a way that it can be closed but it will not open fully. The opening combinations are:

$$AV = \begin{bmatrix} 0 & 1 & 0 & 1 & 0 & 1 & 0 & 1 \\ 0 & 0 & x & x & 0 & 0 & x & x \\ 0 & 0 & 0 & 0 & 1 & 1 & 1 & 1 \end{bmatrix}$$

In case V, the valve opens normally but cannot be closed fully. The opening combinations are:

$$AV = \begin{bmatrix} 0 & 1 & 0 & 1 & 0 & 1 & 0 & 1 \\ x & x & 1 & 1 & x & x & 1 & 1 \\ 0 & 0 & 0 & 0 & 1 & 1 & 1 & 1 \end{bmatrix}$$

In case VI, the valve changes its state but will not open or close fully. The opening combinations are:

$$AV = \begin{bmatrix} 0 & 1 & 0 & 1 & 0 & 1 & 0 & 1 \\ x & x & y & y & x & x & y & y \\ 0 & 0 & 0 & 0 & 1 & 1 & 1 & 1 \end{bmatrix}$$

In a corresponding manner, it is possible to form all the opening combinations if the first or third valve is faulty, or if several valves are faulty at the same time.

Figure 6:
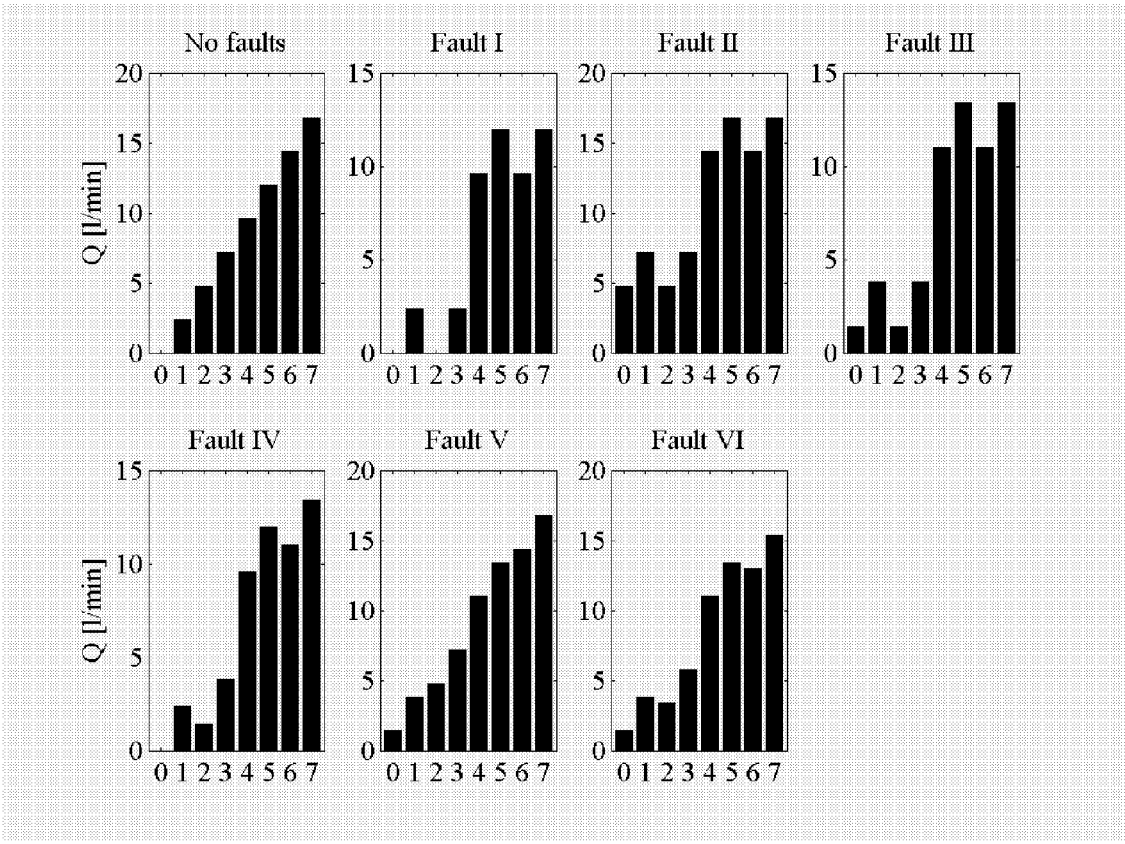
FIG. 6 shows the operation of a digital hydraulic valve system in various fault situations.
Figure 7:
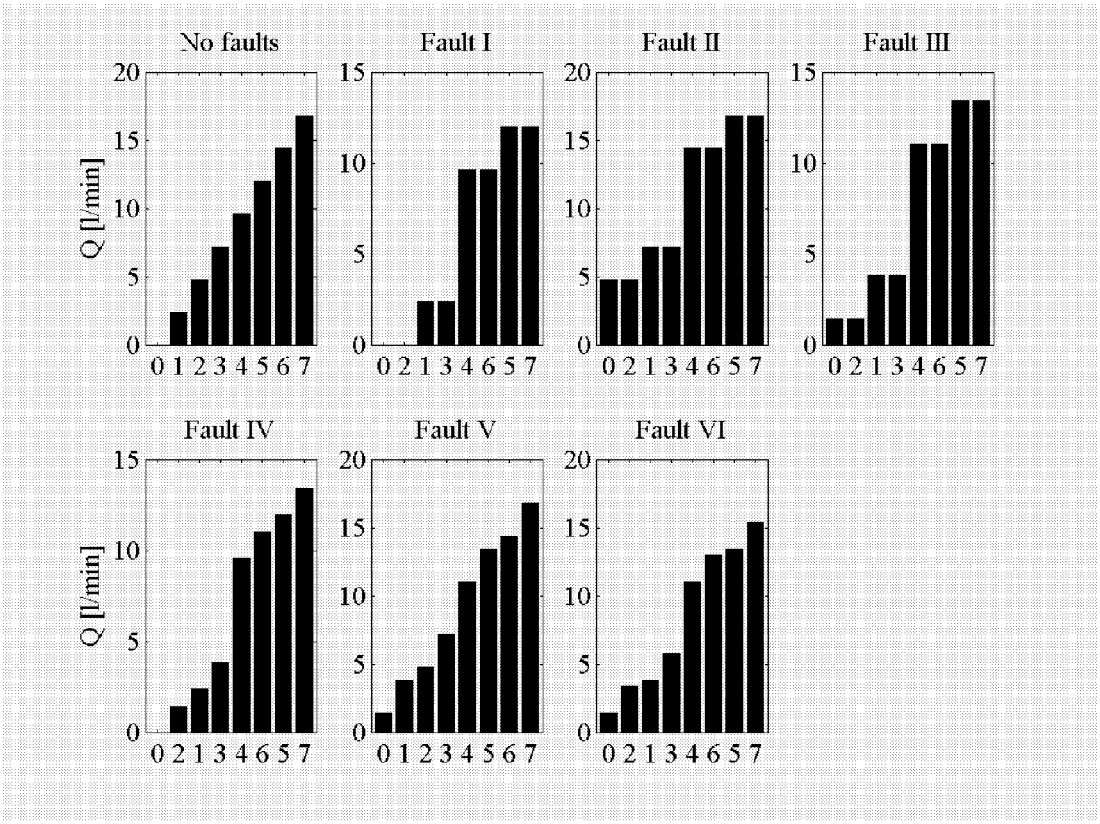
FIG. 7 shows the operation of FIG. 6 when the flow rates are arranged in an order of magnitude.

All the possible flow rates of the DFCU can be calculated by the formula:

$$Q = AV^T \begin{bmatrix} \kappa_1 \\ \kappa_2 \\ \kappa_3 \end{bmatrix} \sqrt{\Delta p}$$

in which $\kappa_1$, $\kappa_2$ and $\kappa_3$ are the flow factors of the valves. FIG. 6 shows the flow rates for a three-valve DFCU in the above-described fault situations by using the following numerical values: $\kappa_1=1\times10^{-8}$ $m^3/(s\ Pa^{0.5})$, $\kappa_2=2\times10^{-8}$ $m^3/(s\ Pa^{0.5})$, $\kappa_3=4\times10^{-8}$ $m^3/(s\ Pa^{0.5})$, x=0.3, y=0.7, $\Delta p$=16 MPa. In the situation of FIG. 6, the middle valve is faulty. FIG. 7 shows the flow rates of FIG. 6 arranged in an order of magnitude. The figure shows that the capacity is reduced, but the controllability of the DFCU is maintained to at least some extent in all fault situations.

Figure 11:
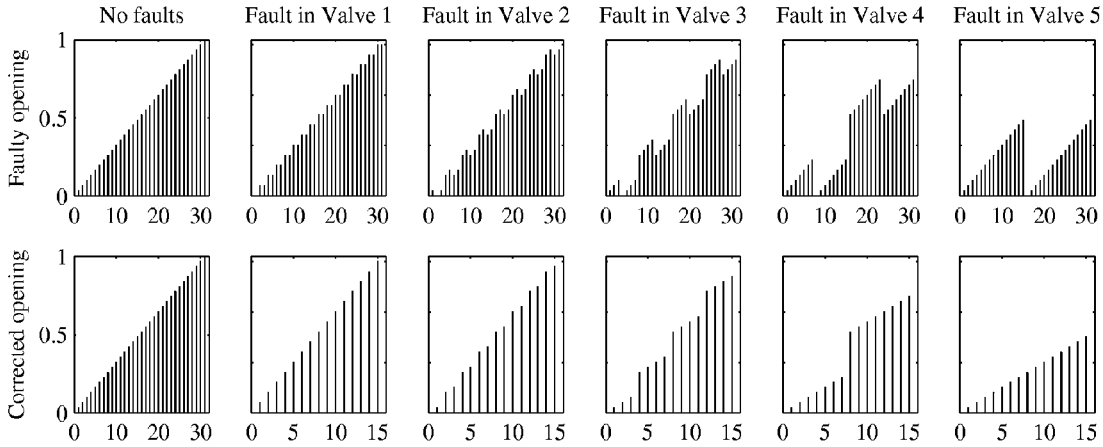
FIG. 11 illustrates the operation of a faulty valve series.

FIG. 11 shows the effect ('Faulty opening') caused by jamming of one valve ('Fault in valve 1', etc.) in the valve series (Table B, Case I), and its compensation ('Corrected opening'). The valve system comprises five valves. FIGS. 6, 7 and 11 show the significant advantage of digital hydraulics to conventional hydraulics: thanks to the valves coupled in parallel, no single valve fault will not nullify the controllability of the DFCU. The situation is made even better by the fact that each flow path can be controlled irrespective of each other. In the following, we shall look at various ways of compensating for faults in valves.

The first step in reacting to faults is detecting the fault, on the basis of which the function av(u) between the valve control and the opening is known. In the following, we shall look at the extend stroke only (for example, the forward motion and extension of a cylinder); the retract stroke (for example, the retracting of a cylinder) can be dealt with in a similar way. The aim of the adjustment or control of an actuator is normally that a given rate and pressure level is achieved with the actuator.

Figure 8A:
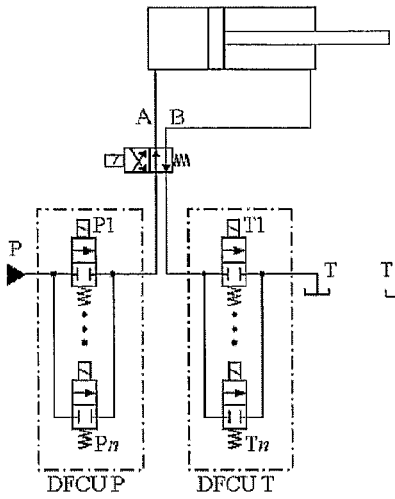
FIG. 8*a* shows the control of an actuator by means of two valve series.
Figure 8B:
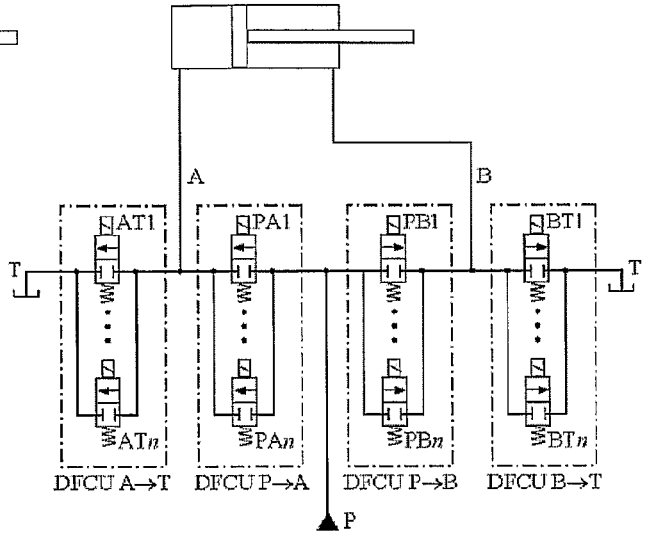
FIG. 8*b* shows the control of an actuator by means of four valve series.

With reference to FIG. 8*b*, a valve system intended for the control of an actuator comprises at least ports P, T, A, and B. The inlet port P (Pump) is arranged for coupling a pressure line in the system to receive a volume flow of a pressurized medium normally from a pump. The outlet port T (Tank) is arranged to couple a return line in the system, the return line being a tank line or a line having a lower pressure level than the pressure line. The first working port A is arranged to couple an actuator (Actuator), such as the piston side of a cylinder, in the system. The second working port B is arranged to couple an actuator, such as the piston rod side of a cylinder, into the system.

The valve system comprises control edges DFCU P→A and DFCU B→T for the extend stroke of the actuator and control edges DFCU P→B and DFCU A→T for the retract stroke (reverse stroke). The DFCU P→A is placed in a first connection between the ports P and A, the DFCU B→T in a second connection between the ports B and T, the DFCU P→B in a third connection between the ports P and B, and the DFCU A→T in a fourth connection between the ports A and T.

With reference to FIG. 8*a*, a valve system intended for the control of an actuator also comprises ports P, T, A, and B. For both the extend stroke and the retract stroke of the actuator, the valve system comprises control edges DFCU P and DFCU T, thus corresponding to either the pair of DFCU P→A and DFCU B→T of the extend stroke or the pair of DFCU P→B and DFCU A→T of the retract stroke in FIG. 8*b*. The reversal is implemented by a separate 4/2 directional valve which reverses the coupling of the actuator.

With reference to FIG. 8*b*, each DFCU consists of simple and robust on/off valves coupled in parallel, wherein for example the DFCU P→A consists of valves PA1 to PAn coupled in parallel, wherein n indicates the total number of valves which is typically 4 to 6, or even greater. The flow rate values to be achieved in different connections and with each valve series are determined according to the principle of table A and on the ratio of openings within the scope of each valve series. The valves are, for example, electrically controlled 2/2 valves (solenoid-controlled on/off valve).

Furthermore, the valve system comprises a control system which comprises a controller card known as such, for example one to be coupled to PC equipment, comprising a programmable microprocessor and the necessary functions, a memory, and e.g. a TTL level I/O connection for the electrical control of the valves. The valves may be controlled, for example, by relays, via which the operating voltage is supplied to the valves. The control system implements the control by means of a stored control algorithm under a system program controlling the apparatus. The control algorithm is formed to provide the desired control, based on the mathematic analysis presented in this description.

If only two DFCU's are used, that is, the inlet and outlet flows are controlled according to FIG. 8*a* or FIG. 8*b*, the equations representing the equilibrium of the system are:

$$(\kappa_{PA1}\alpha v_{PA1}+\kappa_{PA2}+\kappa_{PA2}+\kappa_{P3}\alpha v_{PA3})\sqrt{p_P-p_A}=A_A v$$

$$(\kappa_{BT1}\alpha v_{BT1}+\kappa_{BT2}\alpha v_{BT2}+\kappa_{BT3}\alpha v_{BT3})\sqrt{p_B-p_T}=A_B v$$

$$A_A p_A-A_B p_B=F$$

If the supply pressure $p_P$, the tank pressure $p_T$ and the force F effective on the piston are known ($A_A$ being the surface area of the piston in the cylinder, $A_B$ the area of the cylinder on the side of the piston rod, and K a coefficient representing the throughput of the valve), the formula can be used to solve the pressures $p_A$ and $p_B$ of the cylinder chambers as well as the kinetic speed v of the piston for all the possible valve opening combinations ($A_A v$ being the flow rate $Q_A$ and $A_B v$ being the flow rate $Q_B$). If all the valves are in order (FIG. 6, 'No faults'), then the openings of the DFCU P→A (FIG. 8*a*: DFCU P) and DFCU B→T (FIG. 8*a*: DFCU T) can be set relatively accurately to the desired value, as shown in FIG. 6. In this case, the desired rate and pressure level are achieved relatively accurately. The adjusting method and control system of this case are discussed in more detail in the patent application FI 20010827 A and the corresponding document WO 02/086327 A1, in which a control method and the use of the related optimization function are discussed in more detail from page 13 (line 1) to page 17 (line 29). If either DFCU is faulty (FIG. 6, for example 'Fault I', depending on the fault type of Table B), this will affect the controllability of the opening, for example, according to the examples I to VI of FIG. 7, and the desired rate and pressure level may not necessarily be achieved. However, it is still possible to achieve a good rate control, if the accuracy of the control of the pressure level is compromised. For example, the opening of the DFCU P→A is selected to large and the opening of the DFCU B→T is selected too small, wherein the desired rate is achieved but the pressure level is too high. In this way, the actuator can still be used, but the controllability will be affected to some extent.

Figure 12:
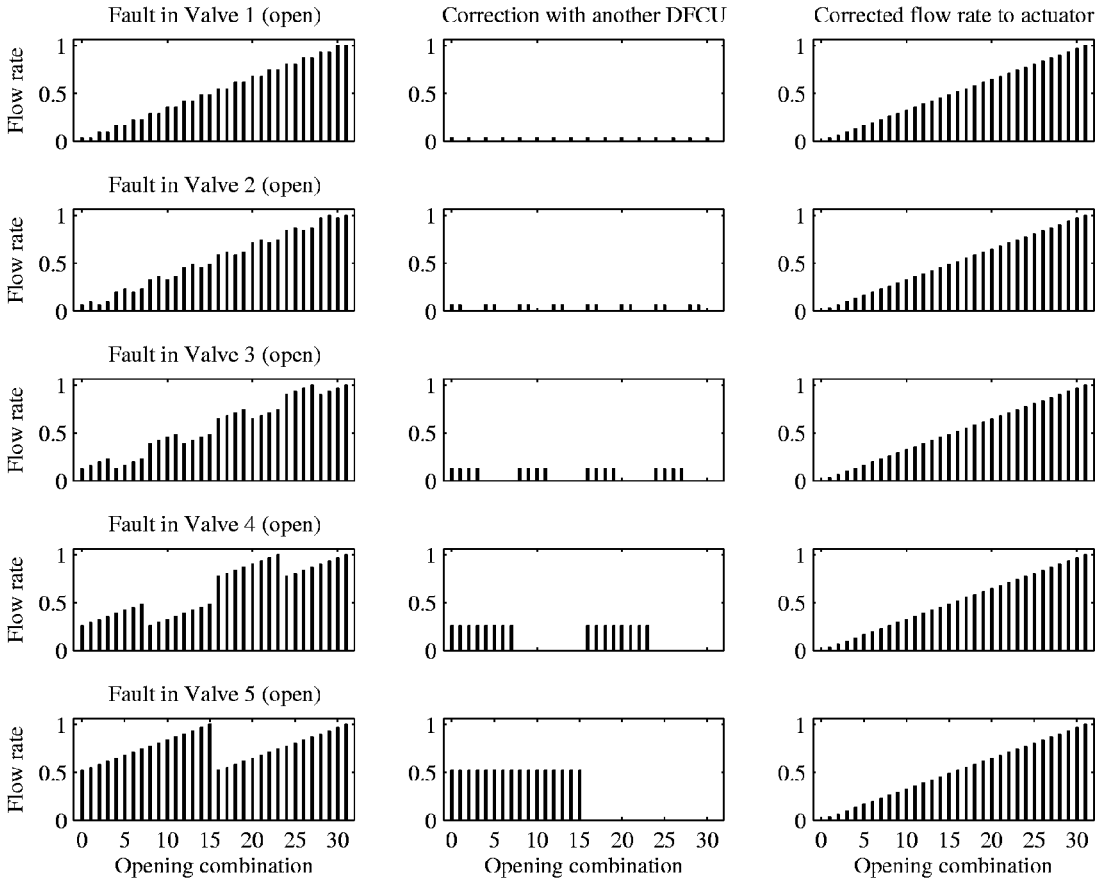
FIG. 12 illustrates the compensation of the operation of a faulty valve series by means of another valve series.

A significantly better compensation for faults is achieved by utilizing the "extra" DFCU's P→B and A→T, as shown in FIG. 8*b*, which are normally not used in the extend stroke (whereas in the retract stroke, the DFCU P→B and the DFCU A→T are in use, and then the DFCU P→A ja the DFCU B→T are normally not in use). Let us first look at a situation in which the controllability of the DFCU P→A has been affected by a fault. To achieve a certain rate and pressure level, the opening of the DFCU P→A should have a certain value, but this value cannot be achieved because of the fault. Thus, it may be possible to select an opening combination with which the opening of the DFCU P→A is too large and simultaneously to open the DFCU A→T slightly, wherein some of the medium will flow into chamber A of the cylinder and some of it will be passed via the DFCU A→T into the tank (port T). FIG. 12 shows the effect that the jamming open of one valve ('Fault in valve 1 (open)', etc.) in the valve series (Table B, Case II) has on the flow rate ('Flow rate'), and the principle of compensating for this ('Correction with another DFCU') by means of another valve series. The principle is to build up a sum flow rate in the right-hand column ('Corrected flow rate to actuator'), wherein the middle column represents the flow rate into the tank line with various opening combinations ('Opening combination'). Mathematically, this situation can be represented by the following equilibrium equations:

$$(\kappa_{PA1}\alpha v_{PA1}+\kappa_{PA2}\alpha v_{PA2}+\kappa_{PA3}\alpha v_{PA3})\sqrt{p_P+p_A}-(\kappa_{AT1}\alpha v_{AT1}+\kappa_{AT2}\alpha v_{AT1}+\kappa_{AT3}\alpha v_{AT3})\sqrt{p_A+p_T}=A_A v$$

$$(\kappa_{BT1}\alpha v_{BT1}+\kappa_{BT2}\alpha v_{BT2}+\kappa_{BT3}\alpha v_{BT3})\sqrt{p_B+p_T}=A_B v$$

$$A_A p_A-A_B p_B=F$$

From the first equation, it can be seen that the flow rate into the chamber A of the cylinder (left hand side of the equation) is the difference between the DFCU P→A and the DFCU:n A→T. If the desired flow rate cannot be achieved with the DFCU P→A only, its opening can be increased and the opening of the DFCU A→T can be adjusted to give a desired sum flow rate. An important conclusion is that the desired rate and pressure level are achieved in spite of the fault in the DFCU P→A. As a result of the compensation, a short-circuit flow is produced from the supply P into the tank T, which increases the power losses. For this reason, it is advantageous to minimize the opening of the DFCU A→T. On side B, the compensation functions according to the same principle; if the DFCU B→T is faulty so that a suitable opening cannot be found, it is opened too much and the DFCU P→B is used for compensation. The only situation in which the compensation is not necessarily successful is the case in which the largest valve of the DFCU B→T remains fully open. In this case, there is a high flow rate through the DFCU B→T, particularly if the pressure $p_B$ is high, and this may not necessarily be fully compensated for by the DFCU P→B. Mathematically, the simultaneous opening of the DFCU's on side B can be represented by the following equations:

$$(\kappa_{PA1}\alpha v_{PA1}+\kappa_{PA2}\alpha v_{PA2}+\kappa_{PA3}\alpha v_{PA3})\sqrt{p_P+p_A}=A_A v$$

$$(\kappa_{PB1}\alpha v_{PB1}+\kappa_{PB2}\alpha v_{PB2}+\kappa_{PB3}\alpha v_{PB3})\sqrt{p_P+p_B}-(\kappa_{BT1}\alpha v_{BT1}+\kappa_{BT2}\alpha v_{BT2}+\kappa_{BT3}\alpha v_{BT3})\sqrt{p_B+p_T}=-A_B v$$

$$A_A p_A-A_B p_B=F$$

By combining the above formulae, the general equilibrium equations are obtained as:

$$(\kappa_{PA1}\alpha v_{PA1}+\kappa_{PA2}\alpha v_{PA2}+\kappa_{PA3}\alpha v_{PA3})\sqrt{p_P+p_A}-(\kappa_{AT1}\alpha v_{AT1}+\kappa_{AT2}\alpha v_{AT1}+\kappa_{AT3}\alpha v_{AT3})\sqrt{p_A+p_T}=A_A v$$

$$(\kappa_{BT1}\alpha v_{BT1}+\kappa_{BT2}\alpha v_{BT2}+\kappa_{BT3}\alpha v_{BT3})\sqrt{p_B+p_T}=-A_B v$$

$$A_A p_A-A_B p_B=F$$

This equation can be used in all situations in both directions, as long as the pressures in the cylinder chambers are between the supply pressure $p_P$ and the tank pressure $P_T$. The formula can also be extended to a situation in which one or both of the chamber pressures of the cylinder are higher than the supply pressure, by replacing the square root function with the function $\mathrm{sgn}(\cdot)*(|\cdot|)^{0.5}$. When not more than three valve series are in use, the effect of the fourth valve series is omitted from the above-mentioned formulae, for example by setting the coefficients of said valve series zero. The above-presented equilibrium equations represent the static model of the system, but a dynamic model can be used in the review as well.

Figure 9:
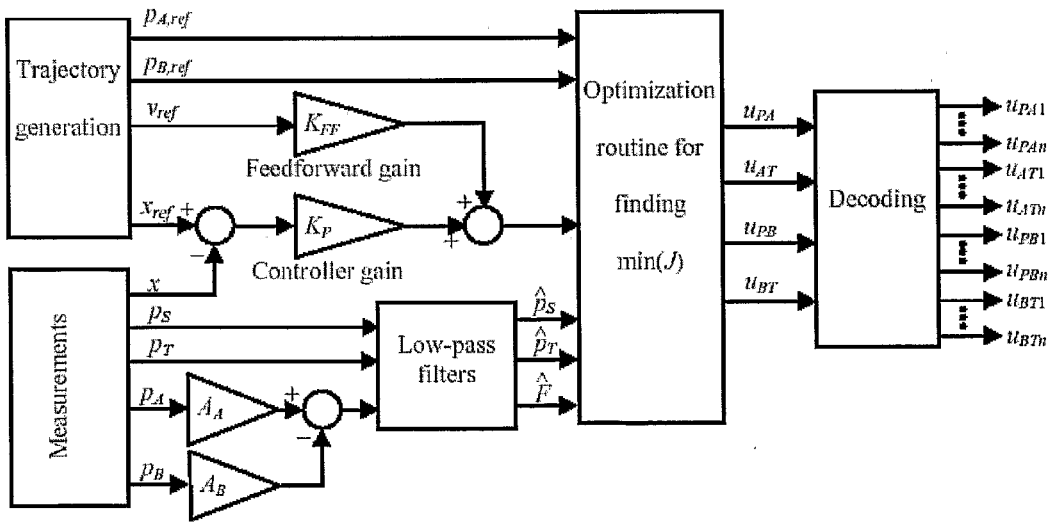
FIG. 9 shows an embodiment of a controller for the valve system.

The valve series are controlled independently by means of the intelligent controller shown in FIG. 9, which can also be reprogrammed, if necessary; in other words, the faults are taken into account as mentioned above. For example, the factors $u_{PA}$, $u_{AT}$, $u_{PB}$ and $u_{BT}$ represent the control of each valve series, and x represents the position measurement used. The factors $p_{A,ref}$, $p_{B,ref}$, $V_{ref}$ and $x_{ref}$ represent target values for the function. In practice, the control and optimization of the valve system are based on finding the best possible opening combination for the different valves at the different control edges, in the search space formed by all the possible combinations. In a fault situation, the search space is changed, for example by eliminating the effect of a given valve or by correcting the effect according to the fault detected.

The adjustment method, the control system (Paragraph 2.4: 'Closed loop control', and Paragraph 3: 'Test system'), and the optimization of this case are discussed in more detail in the conference publication '*Digital hydraulic tracking control of mobile machine joint actuator mockup*'; Linjama M., Vilenius M., The Ninth International Conference on Fluid Power, SICFP'05, Jun. 1-3, 2005 Linköping, Sweden. The adjustment method, the control system (Paragraph 2.4: 'Cost Function Based Control', and Paragraph 3, 'Test system'), and the optimization are also discussed in the article '*Improved digital hydraulic tracking control of water hydraulic motor drive*'; Linjama M., Vilenius M., International Journal of Fluid Power, Volume 6, Number 1, March 2005.

As a result of the fault situation, the optimization is specified so that the error in the flow rate is small, in other words, the error in the rate of the actuator is small, and also the so-called short-circuit flow is small. The short-circuit flow refers, for example, to the short-circuit flow from the inlet P to the tank T via the DFCU A→T. In the optimization, the penalty function known from said publications is applied.

2. Detecting Faults in the Valve System

In the following, we shall describe a testing sequence which can be used, if necessary, to detect and identify single valve faults in a digital hydraulic valve system.

The different embodiments of the method have the following advantages which are typical, particularly for the system of FIG. 8*b*: the actuator does not move during the testing, wherein, for example, various, even bulky apparatuses can be tested also in narrow surroundings and no dangerous or disturbing movements take place; no auxiliary components are needed to separate the part to be tested from the rest of the system; only pressure measurements are needed, and the position or speed of the actuator does not need to be determined; the method can be automated, if position measurement of the actuator is available.

Figure 10:
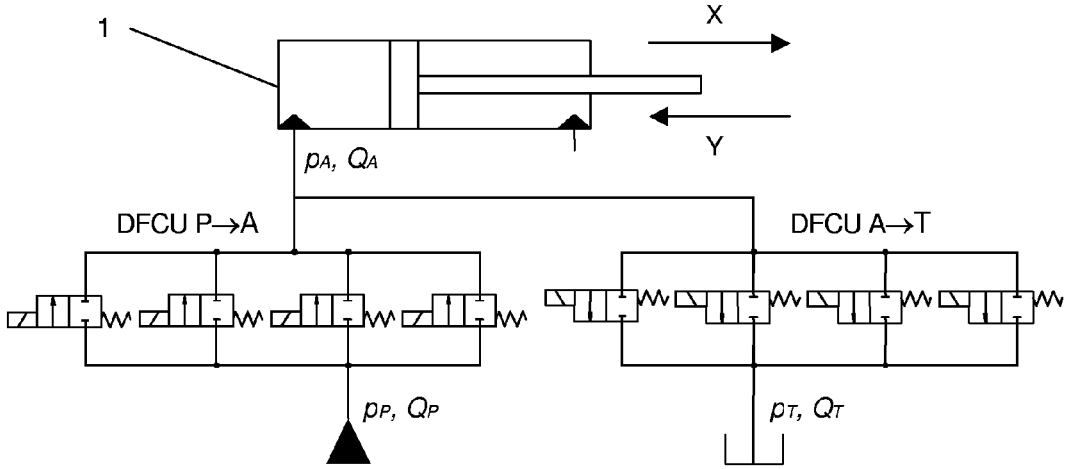
FIG. 10 illustrates the testing of valve series in a valve system.

We shall now discuss the testing of the valves on side A (working port A); side B (working port B) is to be tested in a corresponding way. The situation is shown in FIG. 10. Let us first assume that the loading force is escaping, that is, the load tends to move the actuator 1 in the extend direction (direction X). All the valves on side B are closed during the whole testing. If the system has a controllable supply pressure, it is set to a value distinctly below the maximum pressure of the system.

The testing is based on the fact that if valves are opened in both the DFCU P→A and the DFCU A→T, the pressure in chamber A is set to a certain value, if the actuator is not moving. The function of the valves can be deduced from the measured supply and return pressures as well as the pressure in chamber A. For example, if the smallest valves are opened and the actuator is not moving, then the equilibrium equation for the flow rate on side A is:

$$\kappa_{PA1}\alpha v_{PA1}\sqrt{p_P-p_A}=\kappa_{AT1}\alpha v_{AT1}\sqrt{p_A-p_T} \quad (1)$$

From this, the pressure of chamber A can be solved as:

$$p_A = \frac{\kappa_{PA1}^2 av_{PA1}^2 p_P + \kappa_{AT1}^2 av_{AT1}^2 p_T}{\kappa_{PA1}^2 av_{PA1}^2 + \kappa_{AT1}^2 av_{AT1}^2} \quad (2)$$

Alternatively, it is possible to solve the ratio between the openings of the valves as:

$$\frac{av_{PA1}}{av_{AT1}} = \frac{\kappa_{AT1}\sqrt{p_A - p_T}}{\kappa_{PA1}\sqrt{p_P - p_A}} \quad (3)$$

Consequently, the function of the valves can be tested in two different ways. The first method is to compute the value at which the pressure $p_A$ settles if the valves operate normally (Formula 2). This calculated value is compared with the measured value, and the possible difference is used to conclude, which valve is the faulty one. In another method, the ratio between the valve openings is calculated from the pressure measurements and the known flow coefficients (Formula 3), and the value of the opening ratio is used to conclude, whether the valves operate normally (opening ratio=1) or not (opening ratio≠1).

When the fault or malfunction can be determined, the control of the valve system can be changed so that the real openings are utilized in all the opening combinations, in spite of the fault. For example in Table B, the numbers x and y represent an opening of the valve between the open and closed positions (values 0 and 1).

We shall now present one possible testing procedure (presumptions: escaping load, only valve being faulty):

Step I. Checking that the Valves on Side B are Closed.

Several DFCU A→T valves are opened, and the movement of the actuator is monitored. A movement is detected by means of visual inspection or position measurement of the actuator.

- If the actuator moves in the extend direction, one of the valves of the DFCU B→T is faulty (leaky), wherein the process moves on to the testing of side B.
- If the actuator moves in the retract direction, one of the valves of the DFCU P→B is faulty (leaky), wherein the process moves on to the testing of side B.
- If the actuator is not moving and the pressure on side A drops close to the tank pressure (outlet port T), the testing can be continued.

Step II. Testing if Valves have been Left Open on Side A.

Valve AT1 is opened. According to formula 2, the pressure $p_A$ should drop to the value of the pressure $p_T$. If this does not happen, either the valve AT1 has not opened at all or one of the valves of the DFCU P→A is open. The test is repeated by opening the valve AT2 instead of the valve AT1. If the pressure $p_A$ is still higher than the pressure $p_T$, it can be concluded that one of the valves of the DFCU P→A has been left partly or fully open, and the process moves on to the testing step IV. If the pressures $p_A$ and $p_T$ are equal, it can be concluded that all the valves of the DFCU P→A are closed.

The valves of the DFCU A→T are tested in a similar way. The valve PA1 is opened, wherein according to formula 2, the pressure $p_A$ should rise to the value of the pressure Pp. If this does not happen, either the valve PA1 has not opened or one of the valves of the DFCU A→T is open. The test is repeated for the valve PA2 to make sure that the fault is in one of the valves of the DFCU A→T, and the process moves on to the testing step V.

If it is found that the valves of both the DFCU A→T and the DFCU P→A are closed, the process moves on to step III.

Step III. Searching for Valves of Side A which do not Open at all or Open Only Partly (Fault Situations I and IV).

The valves PA1 and AT1 are opened simultaneously. One should wait until the pressure of chamber A is settled in an equilibrium state. The ratio between the openings PA1 and AT1 is calculated by the formula 3. The operation/failure of the valves is concluded as follows:

- If the ratio is very high, then valve AT1 has not opened at all. Thus, $p_A$ is equal to $p_P$. (Fault situation I)
- If the ratio is close to zero, then valve PA1 has not opened. Thus, $p_A$ is equal to $p_T$. (Fault situation I)
- If the ratio is very close to one, then both valves operate normally.
- If the ratio is smaller than one, then valve PA1 does not open fully (fault situation IV). The value of the opening of PA1 is equal to the value of the calculated opening ratio (symbol x in Table B).
- If the ratio is greater than one, then valve AT1 does not open fully (fault situation IV). The value of the opening of AT1 is equal to the reciprocal of the calculated opening rate.

The operation is similar with the larger valves. Consequently, this test is used to find out a valve failure and a situation in which the valve opens partly as well as the extent to which the valve opens in a case of partial opening.

Step IV. Searching for PA Valves which do not Close at all or Remain Partly Open (Fault Situations II, III, V, (VI)).

The open valve of the DFCU P→A found in step II is identified as follows. Valves of the DFCU A→T are opened one by one, searching for an alternative in which the pressure $p_A$ is closest to the average of the supply and tank pressures. After this, this valve of the DFCU A→T is kept open, and the pressures are measured. Next, the opening ratios are calculated by the formula 3 by using the value K of each valve of the DFCU P→A one by one. Those DFCU P→A valves, for which the calculated opening ratio is greater than one, cannot be faulty, because an opening of the valve can normally not be greater than one. Those valves, for which the calculated opening ratio is equal or smaller than one, are tested one by one. The faulty valve is the one whose opening does not affect the pressure. In this way, the fault situations II and III are detected, and the opening of the faulty valve is equal to the opening ratio calculated by the formula 3.

In a fault situation V, a change in the control of the faulty valve will also affect the opening and the pressure level of the valve. This fault can be detected by opening all the potential DFCU P→A valves one by one and by searching for the one, for which the calculated opening ratio is one when the valve control is one. In this test, it is advantageous to use a DFCU A→T valve, for which the pressure $p_A$ is close to the average of the supply and tank pressures when the DFCU P→A valve to be tested is set to be open. If a valve, for which the opening ratio is one in the open position, cannot be found, then there is the fault situation VI.

Step V. Searching for at Valves which do not Close at all or Remain Partly Open (Fault Situations II, III, V, (VI)).

The open DFCU A→T valve found in step II is identified as follows. Valves of the DFCU P→A are opened one by one, searching for an alternative in which the pressure $p_A$ is closest to the average of the supply and tank pressures. After this, this valve of the DFCU P→A is kept open, and the pressures are measured. Next, the opening ratios are calculated by the formula 3 by using the value K of each valve of the DFCU A→T one by one. Those DFCU A→T valves, for which the calculated opening ratio is less than one cannot be faulty, because an opening of the valve can normally not be greater than one. Those valves, for which the calculated opening ratio is equal or greater than one, are tested one by one. The faulty valve is the one whose opening does not affect the pressure. In this way, it is possible to detect the fault situations II and III, and the opening of the faulty valve is equal to the reciprocal of the opening ratio calculated by the formula 3.

In the fault situation V, a change in the control of the faulty valve will also affect the opening and the pressure level of the valve. This fault is detected by opening all the potential DFCU A→T valves one by one and by searching for the one for which the calculated opening ratio is one, when the valve control is one. In this test, it is advantageous to use a DFCU P→A valve, for which the pressure $p_A$ is close to the average of the supply and tank pressures when the DFCU A→T valve to be tested is set to be open. If a valve, for which the opening ratio is one in the open position, cannot be found, then there is the fault situation VI.

For a resisting load, the testing process is similar in other respects but one must always make sure that the pressure of the actuator chamber on the side of the load remains sufficiently high to prevent a movement of the actuator. This may prevent the use of some opening combinations, but even in this case, at least most of the valves can be tested. In some cases, it is also possible to move the actuator to a position in which the loading force is escaping, or to drive the actuator to an end position, after which the testing is performed.

The above-described testing process is one embodiment for carrying out the testing. It is possible to use also other opening combinations and testing orders than those presented herein. It is essential that a valve is opened from two DFCU's coupled to the same working port, that it is made sure that the actuator is not moving, and that the measured pressure is used to conclude which valve is the faulty one. With respect to the numerical accuracy, it is advantageous to use such opening combinations at which the chamber pressure is not close to the supply and tank pressures.

The invention is not limited solely to the embodiments presented above, but it may vary according to the claims presented in the following.

The invention claimed is:

1. A method for controlling a valve system controlling an actuator, wherein the valve system comprises:

a first valve series coupled between an inlet port and a first working port, the first valve series comprising a set of valves coupled in parallel for controlling the flow rate gradually;

a second valve series coupled between an outlet port and a second working port, the second valve series comprising a set of valves coupled in parallel for controlling the flow rate gradually;

a third valve series coupled between the inlet port and the second working port, the third valve series comprising a set of valves coupled in parallel for controlling the flow rate gradually; and a fourth valve series coupled between the outlet port and the first working port and comprising a set of valves coupled in parallel for controlling the flow rate gradually;

the method comprising:

controlling a first direction of motion of the actuator solely by the first and the second valve series without the help of the third and the fourth valve series; or, controlling a second direction of motion of the actuator solely by the third and the fourth valve series without the help of the first and the second valve series;

detecting a fault situation in a valve series responsible for either the first or the second direction of motion; and compensating for an error in the control of the actuator, the error being caused by the fault situation, by also using the third valve series, or the fourth valve series, or both of them, for the control of the first direction of motion; or, compensating for an error in the control of the actuator, the error being caused by the fault situation, by also using the first valve series, or the second valve series, or both of them, for the control of the second direction of motion.

2. The method according to claim 1, further comprising:

using the fourth valve series, if the first valve series is faulty; or using the third valve series, if the second valve series is faulty.

3. The method according to claim 1, further comprising:

using the second valve series, if the third valve series is faulty; or using the first valve series, if the fourth valve series is faulty.

4. The method according to claim 1, further comprising:

compensating for the fault situation by increasing the flow rate directed from the inlet port either to the first working port or the second working port, and by leading the flow rate from said working port to both the actuator and directly to the outlet port.

5. The method according to claim 1, further comprising:

compensating for the fault situation by increasing the flow rate directed from either the first or the second working port to the outlet port, and by leading the flow rate to said working port from both the actuator and directly from the inlet port.

6. The method according to claim 1, further comprising:

storing matrices representing the control combinations of each valve series and used for the calculation; and replacing the matrix of the faulty valve series with a matrix corresponding to the fault situation.

7. The method according to claim 6, wherein the matrix represents the interdependence of the state of each valve in the valve series and the control of each valve in the valve series in a normal situation or in a fault situation.

8. The method according to claim 7, further comprising:

testing the valve system to detect the fault situation;

determining the interdependency between the state of each valve in the valve series and the control of each valve in the valve series, corresponding to the fault situation; and compensating for the fault situation by utilizing said interdependency.

9. The method according to claim 6, further comprising:

extending the computation after the detection of the fault situation to cover, instead of two valve series, a total of either three or four valve series, to compensate for the fault situation and for the control of either the first or the second direction of motion.

10. The method according to claim 1, further comprising:

storing static or dynamic equations representing the control combinations of each valve series and used for the calculation, representing the operation of the valve system, and taking into account the pressures effective on the actuator and the rate of the actuator, which are dependent on the opening combinations of the valve series; and determining the pressures effective on the actuator and the rate of the actuator by applying opening combinations which are possible in the fault situation.

11. The method according to claim 10, wherein the equations comprise a factor representing the interdependence of the state of each valve in the valve series and the control of each valve in the valve series in a normal situation or in a fault situation.

12. A valve system for the control of an actuator, comprising:

a first valve series coupled between an inlet port and a first working port and comprising a set of valves coupled in parallel for controlling the flow rate gradually;

a second valve series coupled between an outlet port and a second working port and comprising a set of valves coupled in parallel for controlling the flow rate gradually;

a third valve series coupled between the inlet port and the second working port and comprising a set of valves coupled in parallel for controlling the flow rate gradually;

a fourth valve series coupled between the outlet port and the first working port and comprising a set of valves coupled in parallel for controlling the flow rate gradually; and a control system adapted:

to control a first direction of motion of the actuator solely by the first and the second valve series without the help of the third and the fourth valve series; or, controlling a second direction of motion solely by the third and the fourth valve series without the help of the first and the second valve series; and to compensate for an error caused by a fault situation in the control of the actuator by also using the third valve series, or the fourth valve series, or both of them, for the control of the first direction of motion; or, to compensate for an error caused by a fault situation in the control of the actuator by also using the first valve series, or the second valve series, or both of them, for the control of the second direction of motion.

13. The valve system according to claim 12, wherein the control system further comprises stored matrices representing the control combinations of each valve series and used for calculation, wherein the control system is further adapted to replace the matrix of the faulty valve series with a matrix corresponding to the fault situation.

14. The valve system according to claim 12, wherein the control system further comprises stored static or dynamic equations representing the control combinations of each valve series and used for calculation, and describing the operation of the valve system and taking into account the pressures effective on the actuator and the rate of the actuator, which are dependent on the opening combinations of the valve series; wherein the control system is further adapted to determine the pressures effective on the actuator and the rate of the actuator by applying the opening combinations which are possible in the fault situation.

15. A method for finding faults in a valve system controlling an actuator, the valve system comprising:

a first valve series coupled between an inlet port and a first working port and comprising a set of valves coupled in parallel for controlling the flow rate gradually; and a second valve series coupled between an outlet port and the first working port and comprising a set of valves coupled in parallel for controlling the flow rate gradually;

the method comprising:

determining the pressure of the inlet port of the valve system, the pressure of the first working port, and the pressure of the outlet port;

opening one or more valves of the first valve series and one or more valves of the second valve series;

comparing the measured pressure of the first working port with a situation corresponding to the valve system operating correctly; and concluding, on the basis of the comparison, whether a single valve is faulty or not.

16. The method according to claim 15, further comprising:

determining a mutual opening ratio between two valves opened; and checking whether the opening ratio represents the normal operation of the valve system or a fault situation.

17. The method according to claim 16, further comprising:

storing matrices representing the control combinations of each valve series and used for the calculation; and replacing the matrix of the faulty valve series with a matrix corresponding to the fault situation and corrected to correspond to the mutual opening ratio.

18. The method according to claim 15, further comprising:

determining, on the basis of the measured pressures of the inlet port and the outlet port, a calculated value for the pressure of the first working port corresponding to the normal situation; and checking whether said calculated value represents the normal operation of the valve system or a fault situation.

19. The method according to claim 15, further comprising:

storing static or dynamic equations representing the control combinations of each valve series and used for the calculation, representing the operation of the valve system, and taking into account the pressures effective on the actuator and the rate of the actuator, which are dependent on the opening combinations of the valve series; and determining the pressures effective on the actuator and the rate of the actuator by applying opening combinations which are possible in the fault situation.

20. The method according to claim 15, wherein the valve system further comprises:

a third valve series coupled between the inlet port and the second working port and comprising a set of valves coupled in parallel for controlling the flow rate gradually; and a fourth valve series coupled between an outlet port and a second working port and comprising a set of valves coupled in parallel for controlling the flow rate gradually;

the method further comprising:

determining the pressure of the inlet port of the valve system, the pressure of the second working port, and the pressure of the outlet port;

opening one or more valves of the third valve series and one or more valves of the fourth valve series;

comparing the measured pressure of the second working port with a situation corresponding to the valve system operating correctly; and concluding, on the basis of the comparison, whether a single valve is faulty or not.

21. The method according to claim 15, further comprising:

keeping the actuator stationary.

22. A valve system for the control of an actuator, comprising:

a first valve series coupled between an inlet port and a first working port and comprising a set of valves coupled in parallel for controlling the flow rate gradually;

a second valve series coupled between the outlet port and the first working port and comprising a set of valves coupled in parallel for controlling the flow rate gradually; and a control system adapted:

to determine the pressure of the inlet port of the valve system, the pressure of the first working port, and the pressure of the outlet port;

to open one or more valves of the first valve series and one or more valves of the second valve series;

to compare the measured pressure of the first working port with a situation corresponding to the valve system operating correctly; and to conclude, on the basis of the comparison, whether a single valve is faulty or not.

23. The valve system according to claim 22, wherein the control system is further adapted to determine a opening ratio between two opened valves and to check whether the opening ratio represents the normal operation of the valve system or a fault situation.

24. The valve system according to claim 23, wherein the control system comprises stored matrices representing the control combinations of each valve series and used for calculation; wherein the control system is further adapted to replace the matrix of the faulty valve series with a matrix corresponding to the fault situation and corrected to correspond to the mutual opening ratio.

25. The valve system according to claim 22, wherein the control system is further adapted to determine, on the basis of the measured pressure of the inlet port and the pressure of the outlet port, a calculated value for the pressure of the first working port that corresponds to the normal situation, and to check whether said calculated value represents the normal operation of the valve system or a fault situation.

26. The valve system according to claim 22, wherein the control system comprises stored static or dynamic equations representing the control combinations of each valve series and used for calculation, and describing the operation of the valve system and taking into account the pressures effective on the actuator and the rate of the actuator, which are dependent on the opening combinations of the valve series; wherein the control system is further adapted to determine the pressures effective on the actuator and the rate of the actuator by applying the opening combinations which are possible in the fault situation.

* * * * *